US011300265B2

(12) United States Patent
Lee

(10) Patent No.: US 11,300,265 B2
(45) Date of Patent: Apr. 12, 2022

(54) LAMP FOR AUTOMOBILE AND AUTOMOBILE INCLUDING THE SAME

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/318,904

(22) Filed: May 12, 2021

(65) Prior Publication Data

US 2021/0381670 A1 Dec. 9, 2021

(30) Foreign Application Priority Data

Jun. 9, 2020 (KR) ..... 10-2020-0069654

(51) Int. Cl.
*F21S 41/24* (2018.01)
*F21S 41/25* (2018.01)
*F21S 41/43* (2018.01)

(52) U.S. Cl.
CPC ..... *F21S 41/24* (2018.01); *F21S 41/25* (2018.01); *F21S 41/43* (2018.01)

(58) Field of Classification Search
None
See application file for complete search history.

(56) References Cited

U.S. PATENT DOCUMENTS

2017/0292671 A1* 10/2017 Gousset-Rousseau ..... F21S 41/147
2018/0313511 A1* 11/2018 Lee ..... F21S 41/24
2019/0226658 A1* 7/2019 Kawai ..... F21S 41/255
2019/0271447 A1* 9/2019 Choo ..... F21S 41/24
2019/0299846 A1* 10/2019 Chingyo ..... B60Q 1/0011

* cited by examiner

*Primary Examiner* — Elmito Breval
(74) *Attorney, Agent, or Firm* — DLA Piper LLP (US)

(57) ABSTRACT

Disclosed are a lamp for an automobile and an automobile including the lamp. According to one aspect of the present disclosure, provided is a lamp for an automobile, the lamp including: a first light source and a second light source which respectively generate and emit first light and the second light; a first light guide unit and a second light guide unit which are respectively provided in front of the first light source and the second light source and respectively include a first rod and a second rod to provide paths through which the first light and the second light travel; and a lens unit at which the first light emitted from the first light guide unit and the second light emitted from the second light guide unit arrive.

16 Claims, 5 Drawing Sheets

LAMP FOR AUTOMOBILE AND AUTOMOBILE INCLUDING THE SAME

CROSS-REFERENCE TO RELATED APPLICATION(S)

This application claims priority from and the benefit of Korean Patent Application No. 10-2020-0069654, filed on Jun. 9, 2020, which is hereby incorporated by reference for all purposes as if set forth herein.

TECHNICAL FIELD

Exemplary embodiments relate to a lamp for an automobile and an automobile including the lamp.

BACKGROUND

Lamps for automobiles may be mainly divided into head lamps installed in the front of the automobile and tail lamps installed in the rear of the automobile. Among these lamps, the head lamps are mounted to the left and right sides on the front of the automobile and illuminate an area in front of the automobile in situations such as night driving, thereby securing forward visual field of a driver.

Such a head lamp may be classified again into a high beam used when driven on a road without an opposing automobile and a low beam used in general road situations except for the situations using the high beam.

According to the related art, the high beam and the low beam are configured as modules separated from each other, and the head lamp is manufactured by coupling the high beam and the low beam configured as the separate modules. However, the above-described manufacturing method is not efficient in terms of manufacturing costs and times because the high beam and the low beam have to be manufactured separately. In addition, the overall size of the head lamp is increased.

SUMMARY

Exemplary embodiments of the present disclosure is to allow a high beam and a low beam, which constitute a lamp for an automobile, to be provided within a single module, thereby reducing manufacturing costs and times of a head lamp and the size of the head lamp.

A first exemplary embodiment of the present disclosure provides a lamp for an automobile, the lamp including: a first light source configured to generate and emit first light; a second light source provided below the first light source and configured to generate and emit second light; a first light guide unit provided in front of the first light source to receive the first light and including a first rod configured to provide a path through which the first light travels; a second light guide unit provided in front of the second light source to receive the second light and including a second rod configured to provide a path through which the second light travels; and a lens unit at which the first light emitted from the first light guide unit and the second light emitted from the second light guide unit arrive.

The lamp may further include a shield unit which is provided between the first light guide unit and the second light guide unit and configured to block a portion of the first light emitted from the first light guide unit or a portion of the second light emitted from the second light guide unit.

The lens unit may include an upper region and a lower region, wherein the first light emitted from the first light guide unit arrives at the upper region of the lens unit through a straight optical path, and the second light emitted from the second light guide unit arrives at the lower region of the lens unit through a straight optical path.

When a central portion of the lens unit in a left-right direction is cut in a vertical direction, a radius of curvature of a cross-section of the upper region may be different from a radius of curvature of a cross-section of the lower region.

The lens unit may further include a middle region provided between the upper region and the lower region and configured to connect the upper region to the lower region, and a portion of the first light emitted from the first light guide unit may arrive at the middle region.

The first light emitted from the first light guide unit may arrive at the outside through the lens unit and may form a first beam pattern, wherein the first light emitted from an upper region of an exit surface in the first light guide unit, through which the first light is emitted, forms a lower region of the first beam pattern, and the first light emitted from a lower region of the exit surface in the first light guide unit forms an upper region of the first beam pattern.

A stepped portion may be formed on a lower periphery of the exit surface of the first light guide unit, and a boundary of the upper region of the first beam pattern may have a shape corresponding to that of the stepped portion.

The first beam pattern may have a shape formed by vertically inverting a shape of the exit surface of the first light guide unit.

The first light guide unit may be provided above a focus of the upper region of the lens unit.

A portion of the second light emitted from the second light guide unit may arrive at the middle region.

Each of the first light source and the first rod provided in the first light guide unit may be provided in plurality, and the first light sources may correspond one-to-one to the plurality of first rods provided in the first light guide unit.

Each of the second light source and the second rod provided in the second light guide unit may be provided in plurality, and on-off operations of the second light sources may be independently controlled.

The second light emitted from the second light guide unit may arrive at the outside through the lens unit and may form a second beam pattern, wherein the first beam pattern forms a low beam pattern, and the second beam pattern forms a high beam pattern.

The upper region, the middle region, and the lower region of the lens unit may be integrally formed.

A second exemplary embodiment of the present disclosure provides an automobile including a lamp for an automobile, wherein the lamp includes: a first light source configured to generate and emit first light; a second light source provided below the first light source and configured to generate and emit second light; a first light guide unit provided in front of the first light source to receive the first light and including a first rod configured to provide a path through which the first light travels; a second light guide unit provided in front of the second light source to receive the second light and including a second rod configured to provide a path through which the second light travels; and a lens unit at which the first light emitted from the first light guide unit and the second light emitted from the second light guide unit arrive.

The lamp may further include a shield unit which is provided between the first light guide unit and the second light guide unit and configured to block a portion of the first light emitted from the first light guide unit or a portion of the second light emitted from the second light guide unit.

The lamp may be provided in the front region of the automobile, wherein the first light emitted from the first light guide unit arrives at the outside through the lens unit and forms a first beam pattern, and the second light emitted from the second light guide unit arrives at the outside through the lens unit and forms a second beam pattern, wherein the first beam pattern forms a low beam pattern, and the second beam pattern forms a high beam pattern.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Hereinafter, a structure of a lamp for an automobile and a structure of an automobile according to the present disclosure will be described with reference to the drawings.

Lamp for Automobile

Figure 1:
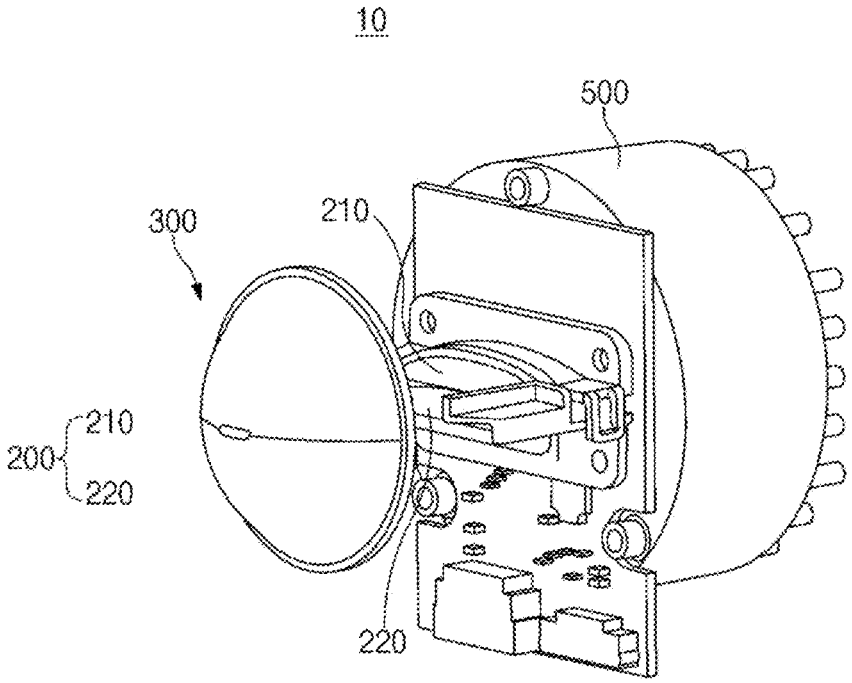
FIG. 1 is a perspective view illustrating an entire structure of a lamp for an automobile according to the present disclosure.
Figure 2:
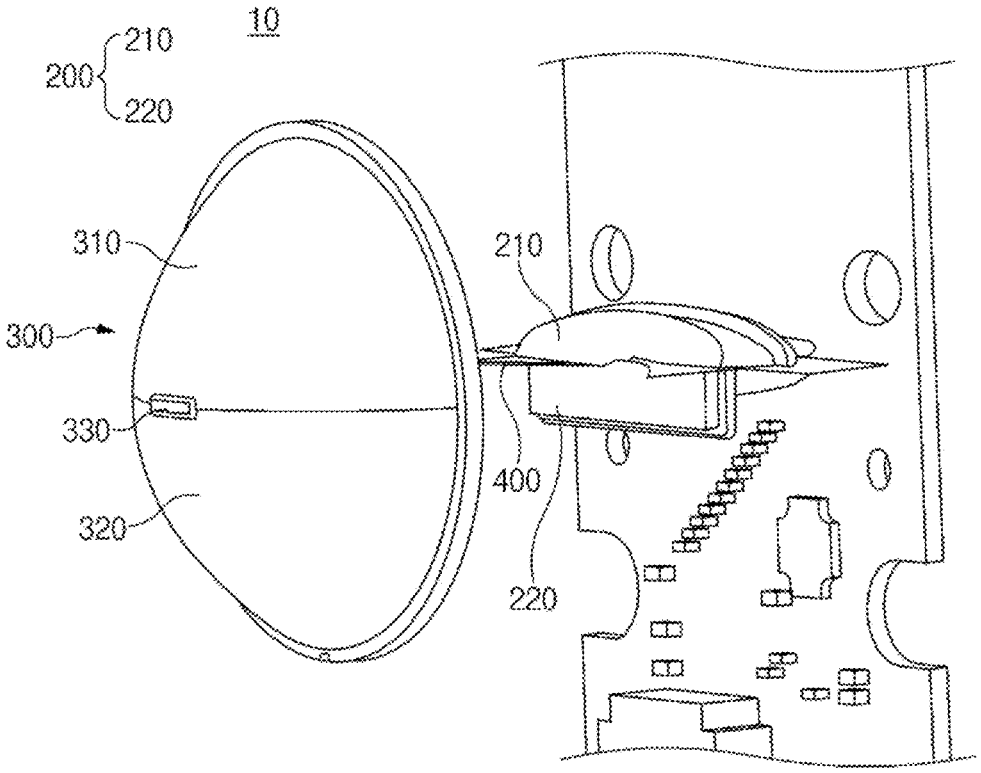
FIG. 2 is an enlarged perspective view illustrating a configuration of a lamp for an automobile according to the present disclosure.
Figure 3:
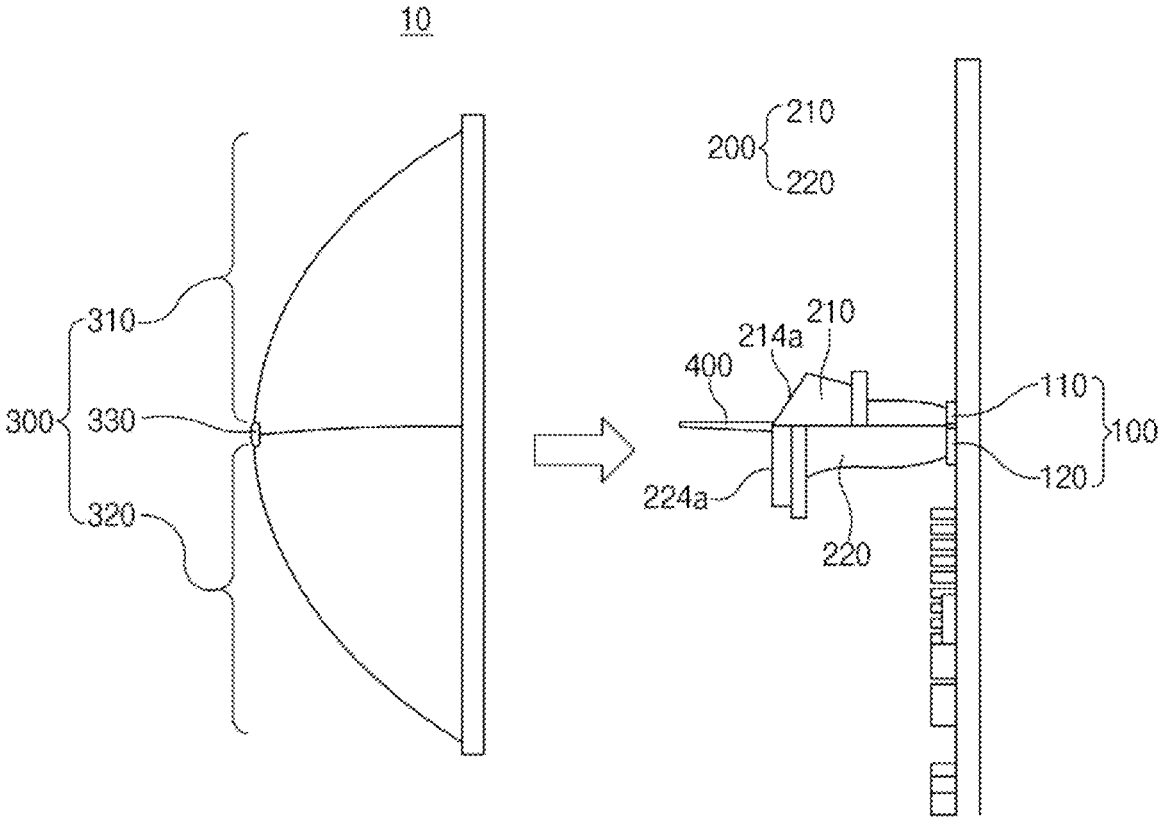
FIG. 3 is an enlarged side cross-sectional view illustrating a configuration of a lamp for an automobile according to the present disclosure.
Figure 4:
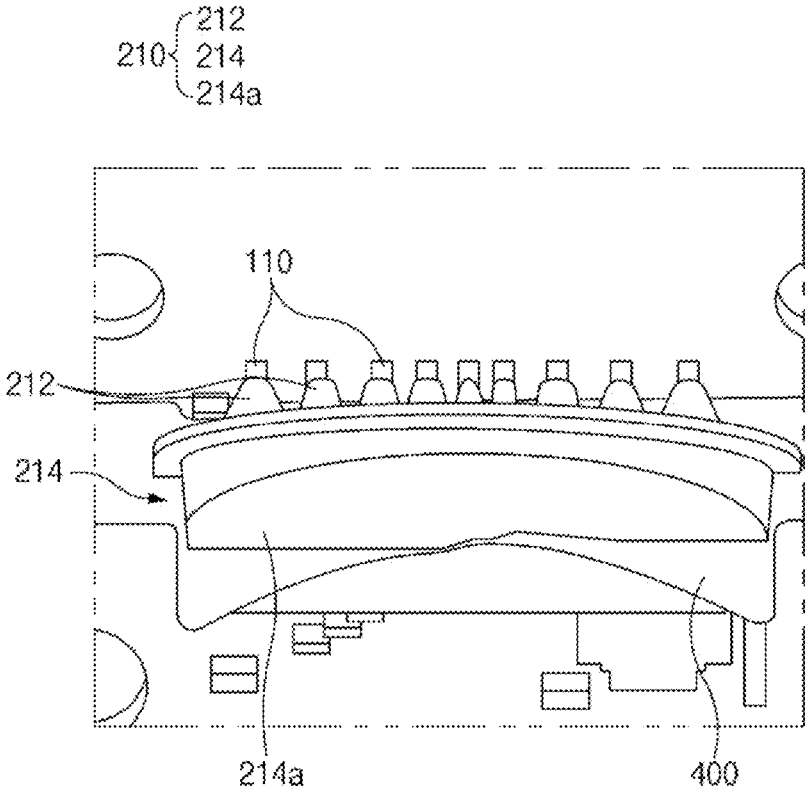
FIG. 4 is an enlarged plan view illustrating a first light source and a first light guide unit of a lamp for an automobile according to the present disclosure.
Figure 5:
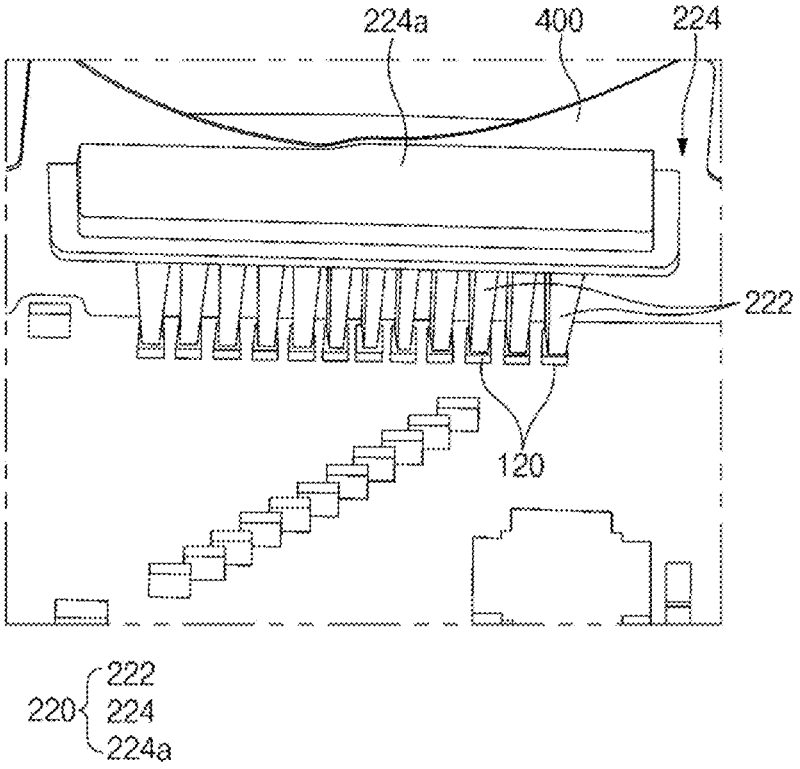
FIG. 5 is an enlarged bottom view illustrating a second light source and a second light guide unit of a lamp for an automobile according to the present disclosure.

FIG. 1 is a perspective view illustrating an entire structure of a lamp for an automobile according to the present disclosure, and FIG. 2 is an enlarged perspective view illustrating a configuration of a lamp for an automobile according to the present disclosure. Also, FIG. 3 is an enlarged side cross-sectional view illustrating a configuration of a lamp for an automobile according to the present disclosure, and FIG. 4 is an enlarged plan view illustrating a first light source and a first light guide unit of a lamp for an automobile according to the present disclosure. Also, FIG. 5 is an enlarged bottom view illustrating a second light source and a second light guide unit of a lamp for an automobile according to the present disclosure.

As illustrated in FIGS. 1 to 3, a lamp 10 for an automobile (hereinafter, referred to as a 'lamp') according to the present disclosure may include a light source unit 100 including a light source that generates and emits light. In more detail, the light source unit 100 may include a plurality of light sources. For example, the light source unit 100 may include a first light source 110, which generates and emits first light, and a second light source 120, which is provided below the first light source 110 and generates and emits second light different from the first light. The first light source 110 and the second light source 120 may include LEDs. Also, each of the first light source 110 and the second light source 120 may be provided in plurality. FIGS. 4 and 5 exemplarily illustrate a state in which nine first light sources 110 and twelve second light sources 120 are provided.

Also, the lamp 10 may include a light guide unit 200 that provides a path for light emitted from the light source unit 100. The light is incident to the path and travels along the path. For example, the light guide unit 200 may include: a first light guide unit 210 provided in front of the first light source 110 to receive the first light and providing a path through which the first light travels; and a second light guide unit 220 provided in front of the second light source 120 to receive the second light and providing a path through which the second light travels.

Referring to FIG. 4, the first light guide unit 210 may include a first rod 212 which is provided facing the first light source 110 and in which the path through which the first light travels is formed. The first light generated in the first light source 110 may move forward through the path which is formed inside the first rod 212. Also, the first rod 212 may be provided in plurality. Here, as illustrated in FIG. 4, the plurality of first light sources 110 may correspond one-to-one to the plurality of first rods 212 provided in the first light guide unit 210.

Also, referring to FIG. 5, the second light guide unit 220 may include a second rod 222 which is provided facing the second light source 120 and in which the path through which the second light travels is formed. The second light generated in the second light source 120 may move forward through the path which is formed inside the second rod 222. Also, the second rod 222 may be provided in plurality. Here, as illustrated in FIG. 5, the plurality of second light sources 120 may correspond one-to-one to the plurality of second rods 222 provided in the second light guide unit 220.

Referring to FIGS. 1 to 3 again, the lamp 10 according to the present disclosure may further include a lens unit 300 which is provided in front of the light guide unit 200 and at which the light emitted from the light guide unit 200 arrives. In more detail, the lamp 10 may further include the lens unit 300 at which the first light emitted from the first rod 212 of the first light guide unit 210 and the second light emitted from the second rod 222 of the second light guide unit 220 arrive. The lens unit 300 may be a convex lens having a shape in which a front portion thereof protrudes forward. More preferably, the lens unit 300 may be an aspheric convex lens.

The lens unit 300 may be divided into a plurality of areas according to shapes. In more detail, as illustrated in FIGS. 2 and 3, the lens unit 300 may include an upper region 310, a lower region 320, and a middle region 330 provided between the upper region 310 and the lower region 320 and connecting the upper region 310 to the lower region 320. Here, the upper region 310, the lower region 320, and the middle region 330, which constitute the lens unit 300, may be integrally formed. This may be understood as that the upper region 310, the lower region 320, and the middle region 330 are inseparably coupled to each other such that these regions may not be separated without irreversible damages. Also, as illustrated in FIGS. 1 to 3, the middle region 330 may have a shape protruding outward from the upper region 310 and the lower region 320.

Also, according to the present disclosure, the light emitted from the light guide unit 200 may arrive at the lens unit 300 through a straight optical path. This may be understood as that the light emitted from the light guide unit 200 arrives at the lens unit 300 by moving straight due to straightness of light until arriving at the lens unit 300 without going through a component (for example, a reflector) causing reflection, refraction, or the like. In more detail, the first light emitted from the first light guide unit 210 may arrive at the upper region 310 of the lens unit 300 through the straight optical path, and the second light emitted from the second light guide unit 220 may arrive at the lower region 320 of the lens unit 300 through the straight optical path.

According to the present disclosure, light sources for implementing different functions may be provided in a single lamp module for an automobile. Thus, the size of the lamp for an automobile may be reduced, and the costs and times required to manufacture the lamp for an automobile may also be reduced compared to the related art. That is, according to the present disclosure, the first light emitted from the first light source travels through the first rod of the first light guide unit, and the second light emitted from the second light source travels through the second rod of the second light guide unit provided separately from the first light guide unit. Thus, the first light emitted from the first light guide unit and the second light emitted from the second light guide unit may perform different functions. In particular, as described later, the first light, which is emitted from the first light source and arrives at the lens unit through the first light guide unit, may form a low beam pattern, and the second light, which is emitted from the second light source and arrives at the lens unit through the second light guide unit, may form a high beam pattern. Thus, according to the present disclosure, the low beam pattern and the high beam pattern may be embodied by the single lamp for an automobile.

Also, according to the present disclosure, the light sources for implementing different functions arrive at the single lens unit and then form the beam patterns outside, and thus, the beam patterns different from each other may be formed through the single lens unit. Thus, even though the beam patterns different from each other are formed, lighting images formed on the lens unit are identical with each other. Thus, unity in exterior design of the lamp may be achieved.

Also, as illustrated in FIGS. 2 to 5, the lamp 10 may further include a shield unit 400 provided between the first light guide unit 210 and the second light guide unit 220. The shield unit 400 may block a portion of the first light emitted from the first light guide unit 210 or a portion of the second light emitted from the second light guide unit 220.

As described above, the first light incident to the first light guide unit 210 travels forward toward the lens unit 300 through the first rod 212, and the second light incident to the second light guide unit 220 travels forward toward the lens unit 300 through the second rod 222.

Here, most of the first light passing through the inside the first rod 212 and the second light passing through the inside of the second rod 222 travel to the ends of the first rod 212 and the second rod 222, respectively, along the longitudinal direction. However, some of the first light and the second light may escape to the outside while traveling inside the first rod 212 and the second rod 222. In this case, the second light may enter the first light guide unit 210, and the first light may enter the second light guide unit 220. Accordingly, the beam patterns formed by the lamp may cause a glare phenomenon.

The shield unit 400 may be a component for preventing the glare phenomenon which may occur in the lamp for an automobile that forms several types of beam patterns to perform the different functions according to the present disclosure. That is, according to the present disclosure, the first light escaping to the outside while traveling inside the first rod 212 may be prevented from entering the second light guide unit 220, and the second light escaping to the outside while traveling inside the second rod 222 may be prevented from entering the first light guide unit 210. Thus, it is possible to prevent the glare phenomenon which may occur in the lamp for an automobile that forms the several types of beam patterns. Here, as illustrated in FIGS. 2 to 4, a recess shape may be formed in a region of a peripheral portion of the shield unit 400 facing the lens unit 300. Also, the shield unit 400 may be provided in close contact with the first light guide unit 210 and the second light guide unit 220.

Here, referring to FIGS. 2 and 3, when a central portion of the lens unit 300 in a left-right direction is cut in a vertical direction, a radius of curvature of a cross-section of the upper region 310 may be different from a radius of curvature of a cross-section of the lower region 320. That is, the radius of curvature of the cross-section of the upper region 310 may be less than the radius of curvature of the cross-section of the lower region 320. On the contrary, the radius of curvature of the cross-section of the lower region 320 may be less than the radius of curvature of the cross-section of the upper region 310. More preferably, the radius of curvature of the lower region 320 may be less than the radius of curvature of the upper region 310.

As described above, the shield unit 400 may be provided between the first light guide unit 210 and the second light guide unit 220, and a region at which the light emitted from the light source does not arrive or a region at which the light does not sufficiently arrive may be formed between the first beam pattern formed by the first light and the second beam pattern formed by the second light due to the thickness of the shield unit 400. Thus, a region in which luminous intensities are rapidly reduced (hereinafter, referred to as a 'luminous intensity degradation region') may be formed between the first beam pattern and the second beam pattern. In particular, in a case where the first beam pattern and the second beam pattern are the low beam pattern and the high beam pattern, respectively, visibility of a driver may be deteriorated due to the luminous intensity degradation region formed in a region between the low beam pattern and the high beam pattern.

However, as in the present disclosure, in a case where the radius of curvature of the cross-section of the upper region 310 is different from the radius of curvature of the cross-section of the lower region 320, when the central portion of the lens unit 300 in the left-right direction is cut in the vertical direction, the luminous intensity degradation region to be formed between the first beam pattern and the second beam pattern due to the shield unit 400 may be removed.

That is, as the radius of curvature of a lens increases, a focus of the lens is also formed away from the lens. For example, when the radius of curvature of the cross-section of the upper region 310 is less than the radius of curvature of the cross-section of the lower region 320, the focus of the upper region 310 is provided relatively close to the lens unit 300. Thus, the focus of the upper region 310 and the focus of the lower region 320 are spaced apart from each other. The first light passes through between the focus of the upper region 310 and the focus of the lower region 320, and thus, the first light may additionally arrive at the luminous intensity degradation region formed between the first beam pattern and the second beam pattern. Therefore, in this case, the luminous intensity degradation region may be removed by the first beam pattern.

Alternatively, when the radius of curvature of the cross-section of the lower region 320 is less than the radius of curvature of the cross-section of the upper region 310, the focus of the lower region 320 may be provided relatively close to the lens unit 300. Thus, the focus of the upper region 310 and the focus of the lower region 320 are spaced apart from each other. The second light passes through between the focus of the upper region 310 and the focus of the lower region 320, and thus, the second light may additionally arrive at the luminous intensity degradation region formed between the first beam pattern and the second beam pattern. Therefore, in this case, the luminous intensity degradation region may be removed by the second beam pattern. More preferably, the focus of the upper region 310 may be provided in a region of the peripheral portion of the shield unit 400 facing the lens unit 300 or within the shield unit 400, and the focus of the lower region 320 may be provided between the lens unit 300 and the shield unit 400. A portion of the second light passes through between the focus of the lower region 320 and the shield unit 400, and thus, the luminous intensity degradation region may be removed.

Also, as described above, the first light emitted from the first light guide unit 210 arrives at the outside through the lens unit 300 and may form the first beam pattern, and the second light emitted from the second light guide unit 220 arrives at the outside through the lens unit 300 and may form the second beam pattern. More preferably, the first beam pattern may form a low beam pattern, and the second beam pattern may form a high beam pattern.

Here, on-off operations of the plurality of second light sources 120 provided in the light source unit 100 may be independently controlled. Thus, compared to a case where all of the plurality of second light sources 120 are turned on, a dark region may be formed in the second beam pattern (that is, the high beam pattern) in a case where some of the plurality of the second light sources 120 are turned off. This is to prevent dazzling of a driver in another automobile or dazzling of a pedestrian when another automobile or the pedestrian is present in front of the automobile equipped with the lamp.

Also, according to the present disclosure, the first light guide unit 210 may further include a first body portion 214. The first body portion 214 forms a body of the first light guide unit 210, surrounds at least some of the plurality of first rods 212, and has, on a surface facing the lens unit 300, an exit surface 214*a* through which the first light is emitted. Also, the second light guide unit 220 may further include a second body portion 224. The second body portion 224 forms a body of the second light guide unit 220, surrounds at least some of the plurality of second rods 222, and has, on a surface facing the lens unit 300, an exit surface 224*a* through which the second light is emitted.

Here, the first beam pattern may have a shape formed by vertically inverting a shape of the exit surface 214*a* of the first light guide unit 210. Thus, the first light emitted from an upper region of the exit surface 214*a* in the first light guide unit 210 may form a lower region of the first beam pattern, and the first light emitted from a lower region of the exit surface 214*a* in the first light guide unit 210 may form an upper region of the first beam pattern. Also, the second light emitted from an upper region of the exit surface 224*a* in the second light guide unit 220 may form a lower region of the second beam pattern, and the second light emitted from a lower region of the exit surface 224*a* in the second light guide unit 220 may form an upper region of the second beam pattern.

This may be due to the characteristics of a convex lens. According to the characteristics, the light incident from above the focus of the convex lens is refracted and moved downward while passing through the convex lens and, the light incident from below the focus of the convex lens is refracted and moved upward while passing through the convex lens.

Thus, the first light guide unit 210 may be provided above the focus of the lens unit 300. In more detail, the first light guide unit 210 may be provided above the focus of the upper region 310 of the lens unit 300. Also, the second light guide unit 220 may be provided below the focus of the lens unit 300. In more detail, the second light guide unit 220 may be provided below the focus of the lower region 320 of the lens unit 300.

Also, as illustrated in FIGS. 2 and 4, a stepped portion is formed on a lower periphery of the exit surface 214*a* of the first body portion 214 provided in the first light guide unit 210. Here, as described above, the first beam pattern may have the shape formed by vertically inverting the shape of the exit surface 214*a* of the first light guide unit 210, and thus, a boundary of the upper region of the first beam pattern has a shape corresponding to that of the stepped portion. The first beam pattern may be the low beam pattern as described above, and the stepped portion formed on the exit surface 214*a* of the first light guide unit 210 may be configured to form a cut-off line on an upper boundary of the low beam pattern.

Also, according to the present disclosure, the first beam pattern formed by the first light and the second beam pattern formed by the second light may overlap each other in at least some regions. For this, each of a portion of the first light emitted from the first light guide unit 210 and a portion of the second light emitted from the second light guide unit 220 may arrive at the middle region 330 of the lens unit 300.

As described above, the first beam pattern may be a low beam pattern, and the low beam may be formed in a lower region in front of an automobile. In particular, a cut-off line may be formed on an upper boundary of the low beam pattern.

However, a portion of the first light emitted from the first light source 110 needs to arrive even at an upper region of the low beam pattern. This is a legal requirement for performance of a lamp for an automobile, and a safety accident, which is likely to occur when forming only the low beam pattern without forming the high beam pattern, may be prevented by allowing a driver to recognize at least the presence or absence of an object even in an upper region outside the low beam pattern.

Also, referring to FIGS. 1 and 3, the lamp 10 according to the present disclosure may further include a heat dissipation unit 500 provided behind the first light source 110 and the second light source 120. The heat dissipation unit 500 may be a component which absorbs heat generated from the first light source 110 and the second light source 120 and discharges the heat to the outside.

Automobile

An automobile according to the present disclosure may include the lamp 10 for an automobile described above.

Here, referring to FIGS. 1 to 5, the lamp 10 for an automobile may include: a first light source 110 which generates and emits first light; a second light source 120 which is provided below the first light source 110 and generates and emits second light; a first light guide unit 210 which is provided in front of the first light source 110 to receive the first light and includes a first rod 212 to provide a path through which the first light travels; a second light guide unit 220 which is provided in front of the second light source 120 to receive the second light and includes a second rod 222 to provide a path through which the second light travels; a lens unit 300 at which the first light emitted from the first light guide unit 210 and the second light emitted from the second light guide unit 220 arrive; and a shield unit 400 which is provided between the first light guide unit 210 and the second light guide unit 220 and blocks a portion of the first light emitted from the first light guide unit 210 or a portion of the second light emitted from the second light guide unit 220.

According to the present disclosure, the high beam and the low beam, which constitute a lamp for an automobile, may be provided within the single module. Thus, the manufacturing costs and times of the head lamp may be reduced, and the size of the head lamp may be reduced.

Although the present disclosure has been described with specific exemplary embodiments and drawings, the present disclosure is not limited thereto, and it is obvious that various changes and modifications may be made by a person skilled in the art to which the present disclosure pertains within the technical idea of the present disclosure and equivalent scope of the appended claims.

What is claimed is:

1. A lamp for an automobile, the lamp comprising:

a first light source configured to generate and emit first light;

a second light source provided below the first light source and configured to generate and emit second light;

a first light guide unit provided in front of the first light source and configured to receive the first light, the first light guide unit comprising a first rod configured to provide a path through which the first light travels;

a second light guide unit provided in front of the second light source and configured to receive the second light, the second light guide unit comprising a second rod configured to provide a path through which the second light travels; and a lens unit at which the first light emitted from the first light guide unit and the second light emitted from the second light guide unit arrive, wherein the lens unit comprises an upper region and a lower region, wherein the first light emitted from the first light guide unit arrives at the upper region of the lens unit through a straight optical path, and the second light emitted from the second light guide unit arrives at the lower region of the lens unit through a straight optical path.

2. The lamp of claim 1, further comprising a shield unit which is provided between the first light guide unit and the second light guide unit and configured to block a portion of the first light emitted from the first light guide unit or a portion of the second light emitted from the second light guide unit.

3. The lamp of claim 1, wherein a radius of curvature of a cross-section of the upper region is different from a radius of curvature of a cross-section of the lower region along a line in a vertical direction through a central portion of the lens unit in a left-right direction.

4. The lamp of claim 1, wherein the lens unit further comprises a middle region provided between the upper region and the lower region and configured to connect the upper region to the lower region, and a portion of the first light emitted from the first light guide unit arrives at the middle region.

5. The lamp of claim 4, wherein a portion of the second light emitted from the second light guide unit arrives at the middle region.

6. The lamp of claim 4, wherein the upper region, the middle region, and the lower region of the lens unit are integrally formed.

7. The lamp of claim 1, wherein the first light emitted from the first light guide unit arrives at an outside of the lamp through the lens unit and forms a first beam pattern, wherein the first light emitted from an upper region of an exit surface in the first light guide unit, through which the first light is emitted, forms a lower region of the first beam pattern, and the first light emitted from a lower region of the exit surface in the first light guide unit forms an upper region of the first beam pattern.

8. The lamp of claim 7, wherein a stepped portion is formed on a lower periphery of the exit surface of the first light guide unit, and a boundary of the upper region of the first beam pattern has a shape corresponding to that of the stepped portion.

9. The lamp of claim 7, wherein the first beam pattern has a shape formed by vertically inverting a shape of the exit surface of the first light guide unit.

10. The lamp of claim 7, wherein the first light guide unit is provided above a focus of the upper region of the lens unit.

11. The lamp of claim 7, wherein the second light emitted from the second light guide unit arrives at the outside through the lens unit and forms a second beam pattern, wherein the first beam pattern forms a low beam pattern, and the second beam pattern forms a high beam pattern.

12. The lamp of claim 1, wherein each of the first light source and the first rod provided in the first light guide unit is provided in plurality, and the first light sources correspond one-to-one to the plurality of first rods provided in the first light guide unit.

13. The lamp of claim 1, wherein each of the second light source and the second rod provided in the second light guide unit is provided in plurality, and on-off operations of the second light sources are independently controlled.

14. An automobile comprising a lamp for an automobile, wherein the lamp comprises:

a first light source configured to generate and emit first light;

a second light source provided below the first light source and configured to generate and emit second light;

a first light guide unit provided in front of the first light source and configured to receive the first light, the first light guide unit comprising a first rod configured to provide a path through which the first light travels;

a second light guide unit provided in front of the second light source and configured to receive the second light, the second light guide unit comprising a second rod configured to provide a path through which the second light travels; and a lens unit at which the first light emitted from the first light guide unit and the second light emitted from the second light guide unit arrive, wherein the lens unit comprises an upper region and a lower region, wherein the first light emitted from the first light guide unit arrives at the upper region of the lens unit through a straight optical path, and the second light emitted from the second light guide unit arrives at the lower region of the lens unit through a straight optical path.

15. The automobile of claim 14, wherein the lamp further comprises a shield unit which is provided between the first light guide unit and the second light guide unit and configured to block a portion of the first light emitted from the first light guide unit or a portion of the second light emitted from the second light guide unit.

16. The automobile of claim 14, wherein the lamp is provided in a front region of the automobile, wherein the first light emitted from the first light guide unit arrives at an outside of the lamp through the lens unit and forms a first beam pattern, and the second light emitted from the second light guide unit arrives at the outside through the lens unit and forms a second beam pattern, wherein the first beam pattern forms a low beam pattern, and the second beam pattern forms a high beam pattern.

* * * * *